United States Patent [19]

Vettorello

[11] 4,330,124

[45] May 18, 1982

[54] TAMBURELLO

[76] Inventor: Emilio Vettorello, Centro 20, Bigolino, Italy, 31030

[21] Appl. No.: 966,633

[22] Filed: Dec. 5, 1978

[30] Foreign Application Priority Data

Dec. 6, 1977 [IT] Italy ..... 41722 A/77
Oct. 30, 1978 [IT] Italy ..... 30844/78[U]

[51] Int. Cl.[3] ..... A63B 59/18; G10D 13/02
[52] U.S. Cl. ..... 273/67 B; 84/418
[58] Field of Search ..... 273/95 R, 96 R, 67 R, 273/67 B, 76; 84/411, 414, 418, 420, 413

[56] References Cited

U.S. PATENT DOCUMENTS 1,700,251 1/1929 Contolini ..... 273/67 B
3,185,479 5/1965 Ortega ..... 273/96 R
3,620,118 11/1971 Koishikawa ..... 84/418

FOREIGN PATENT DOCUMENTS 282936 2/1966 Australia ..... 273/67 R
496281 7/1919 France ..... 84/411
626408 10/1961 Italy ..... 84/414
16681 of 1903 United Kingdom ..... 273/75

*Primary Examiner*—George J. Marlo
*Attorney, Agent, or Firm*—Pennie & Edmonds

[57] ABSTRACT

Disclosed is a tamburello (1) used like a paddle or racket in striking a ball and comprising a drum (2) having a membrane (3) tautly stretched across one open end of the drum (2) and secured thereto by a rim (4). The rim (4) has a wedge shaped depending wall (20) which engages in an annular groove (26) in the drum with the membrane (3) securely locked therebetween. A strap (10) is secured by integral lugs (5 and 6) to the drum (2) through which the hand of the user passes with the fingers of the user gripping a hand grip (13) positioned in alignment with the strap (10) on the opposite end of the drum (2) from the membrane (3).

12 Claims, 6 Drawing Figures

FIG.1
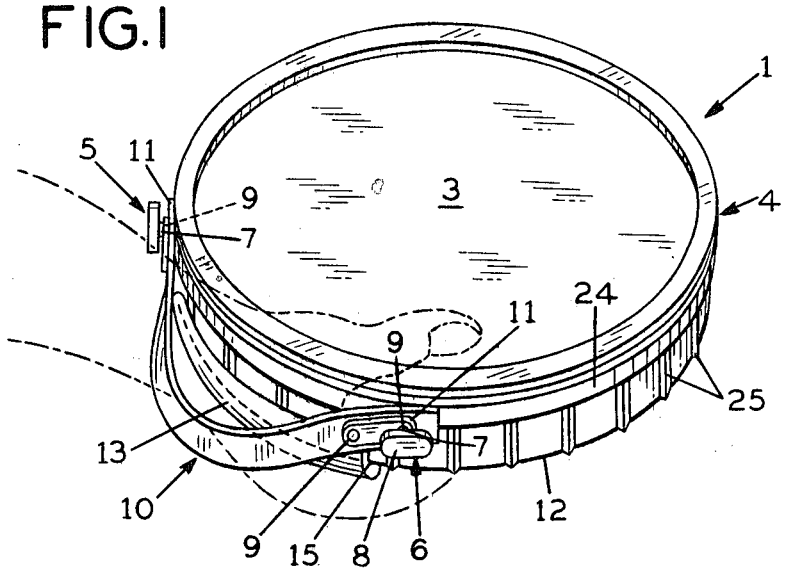
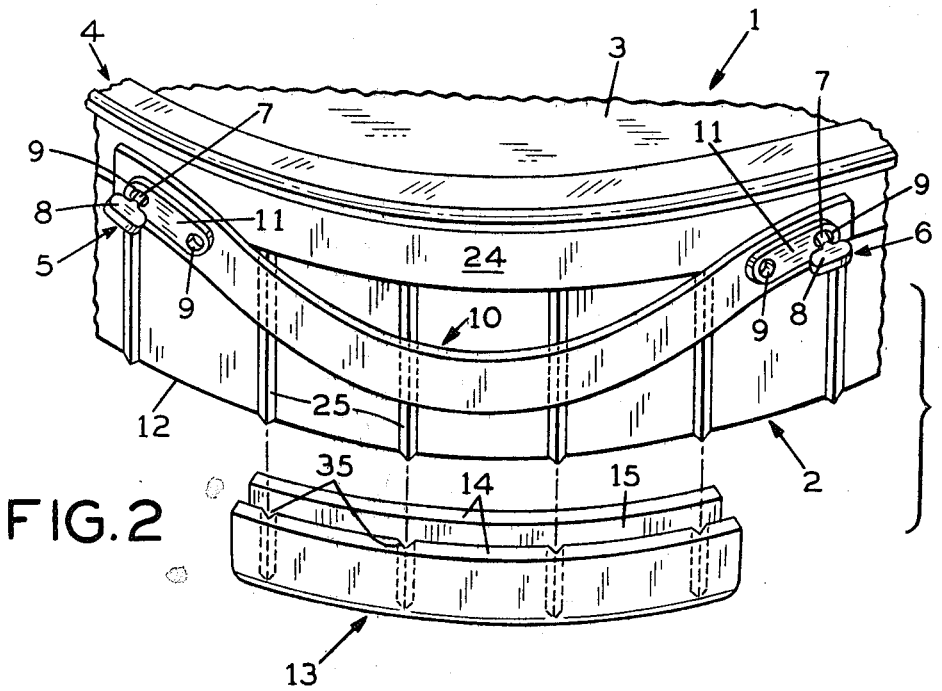
FIG.2
FIG.3
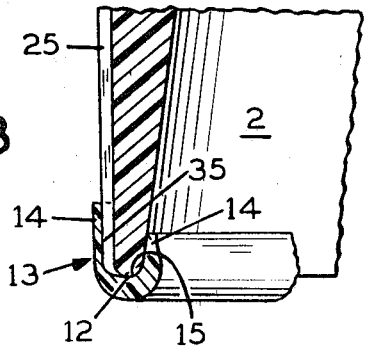

TAMBURELLO

BACKGROUND

1. Technical Field

A tamburello is a type of paddle or racket used in a game called palla tamburello which has been popular in Italy for as long as four centuries. The game may be played informally among two or more players in which a ball is batted back and forth using the tamburello or it may be played in an organized fashion on a court of specified size, usually 20 meters by 80 meters between two five-man teams. Aside from the court and any markings thereon the only equipment utilized is a tamburello for each player and a ball.

2. The Prior Art

The tamburello is reminiscent of a tambourine in that it has a rigid drum or rim across which is stretched a suitable membrane. The traditional tamburello was constructed by laying up fillets of wood and then machining it to a perfectly round shape and using an animal hide or stomach as a membrane secured to the drum by nails, studs, pegs or the like. Conventionally, the hide was wetted and stretched before being applied thus tightening as it dried.

In more recent years as professional teams appeared the traditional wood and hide tamburello has been replaced by tamburellos made from plastic with various materials for the membrane. By their nature the professional models available are quite expensive and not suitable for amatures or as toys to be used by children. For such purposes the conventional tamburello of wood and hide or even using stiff papers have been all that was available. Such wood and hide or paper tamburellos are easily damaged by the weather particularly moisture or rain and are very difficult to draw tightly with any sort of uniformity. If the membrane becomes slackened the device becomes useless and moisture readily slackens the hide materials or destroys paper. Still further, if the membrane is taut at one point and slack at another point so that it is non-uniform in its tautness it then becomes undependable as a useful tamburello.

BRIEF SUMMARY OF THE INVENTION

The present invention aims to overcome the disadvantages of the above-mentioned available lower cost tamburellos by use of a suitable plastic for the drum, use of suitable synthetic materials for the membrane and, importantly, by a specially designed mechanism for securing the membrane in place economically by use of a rim and groove arrangement wherein a rim having a depending wall is locked into one edge of the drum with the membrane drawn tightly therebetween. Cooperating lips within the groove of the drum and on the wall of the rim engage each other with the material of the membrane there-between and securely held in place.

Additionally, an economical handle is provided in which "T" shaped members are integrally molded with the drum and are engaged in one of a number of selected holes in the handle member whereby the handle may be adjusted to the user's hand size. A grip on the opposite edge of the drum provides for a comfortable grasping of the edge by the fingers of the user and is also made of plastic.

BRIEF DESCRIPTION OF THE DRAWINGS

The construction, assembly and use of the device will be apparent to those skilled in the art from the following description and drawings in which:

FIG. 1 is a perspective view of the tamburello of the present invention showing the front face thereof;

FIG. 2 is an enlarged, exploded view in perspective of a portion of FIG. 1;

FIG. 3 is a cross-section through a portion of the drum showing the manner of engagement by the hand grip;

DETAILED DESCRIPTION OF THE PREFERRED EMBODIMENT

Figure 4:
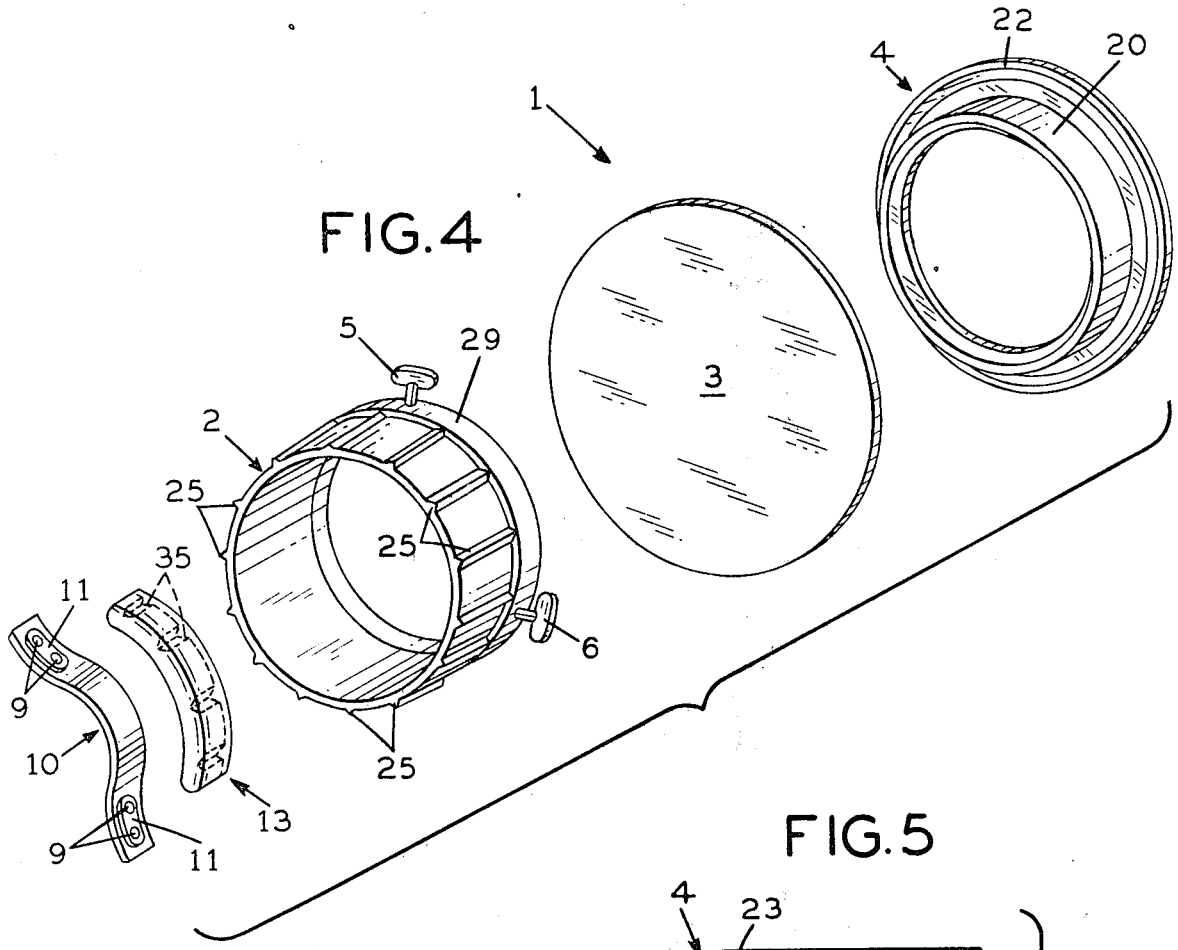
FIG. 4 is an exploded perspective view of the tamburello show from below prior to assembly.

As shown in FIG. 1 the tamburello 1 comprises a shallow drum shaped cylindrical member 2 referred to hereinafter as the drum. The tamburello 1 also includes a taut membrane 3 secured to the drum 2 by the rim 4 as explained in detail hereinafter. As will be apparent from the drawings, the side of the drum 2 opposite to the membrane 3 is open. The drum 2 is preferably of injection molded plastic and may be of any suitable material with polypropylene or acrilonitrilebutadienestyrene (ABS) being preferred. Integrally molded with the drum 2 are two T shaped ears 5 and 6 (see FIG. 2) to which is secured a handle 10. In alignment with the handle 10 and engaged about the open lower edge 12 of the drum 2 is a hand grip 13.

In use the hand is passed through the handle 10 from top to bottom as viewed in FIG. 2 and the fingers grip about the hand grip 13 on the lower edge 12 of the drum 2. The thumb bears against the front face of the tamburello 1 bearing against one or both of the rim 4 and the membrane 3.

The handle 10 has a plurality of holes 9 with two holes 9 adjacent each end of the handle 10 being shown. The holes 9 provide for adjustment of the size of the handle 10. The strap or handle 10 may be of any suitable material but must be slightly elastic in order to permit the hole 9 to be first engaged over one side of the head 8 of the T shaped members 5 and 6 and then moved and stretched over the opposite end of the head 8 and finally released to embrace the shank 7 of the T shaped member 5 or 6. The stretching need not be great but should be sufficient for the purpose. An oval area 11 encompassing the holes 9 at each end is thickened with respect to the remainder of the strap 10 in order to strengthen this area about the holes. Polyethylene has been found suitable as a material for the handle 10 through other materials are also suitable.

The finger grip 13 comprises a U shaped member having spaced walls 14 defining a channel 15 which engages with the lower edge 12 of the drum 2. On its outer surface the drum 2 has thickened ridges 25 extending from the edge 12 throughout most of the height of the drum 2 for purposes of reinforcement and the finger grip 13 has cooperating grooves 35 molded therein to receive such ridges 25. Like the handle 10 the finger grip 13 may be of molded polyethylene and dimensioned to fit snugly and frictionally engage the wall of the drum 2 with no need for further adhesive or other securement means.

Figure 5:
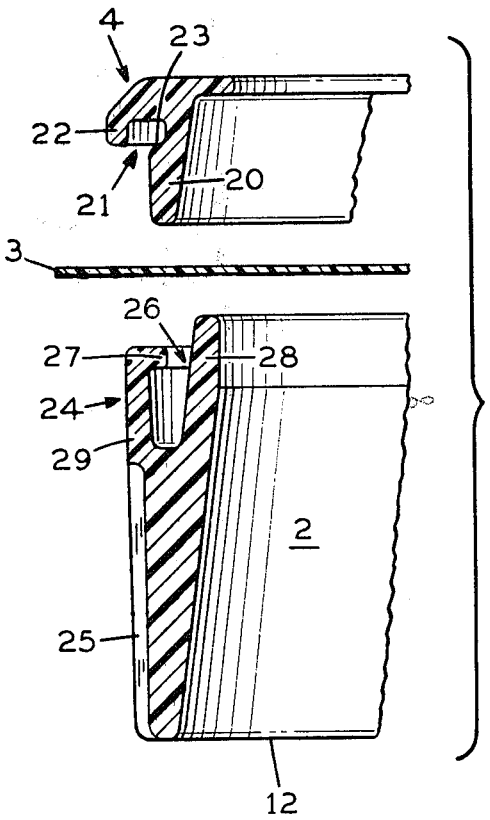
FIG. 5 is an enlarged, exploded cross-section of a portion of the tamburello prior to assembly.
Figure 6:
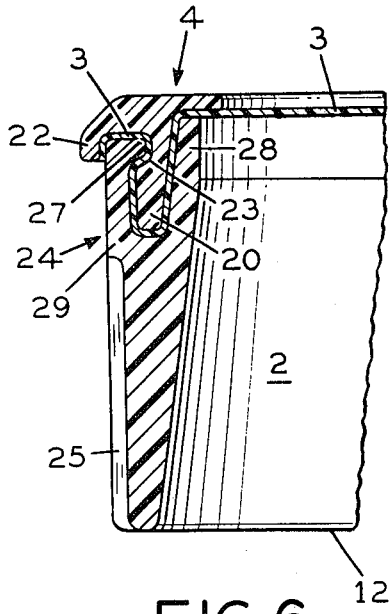
FIG. 6 is a view similar to FIG. 5 reduced in scale and showing the parts of the tamburello as assembled.

As shown in FIG. 4 the tamburello is presented in an exploded view prior to assembly and comprises the drum 2, the membrane 3 and the membrane securing rim 4. As shown in FIGS. 4 through 6 the drum 2 includes thickened ribs 25 running from the bottom edge 12 upwardly to an annular ridge generally indicated at 24 on the upper end of the drum 2. This annular ridge 24 comprises a wall 29 having an inwardly extending portion at the top providing a lip 27 on the underside thereof. Spaced inwardly from the wall 29 is a wall 28 of slightly greater height and extending entirely around the drum 2. Accordingly, a space 26 is provided between the spaced annular walls 28 and 29 as clearly shown in FIG. 5.

As shown in FIGS. 5 and 6 the annular rim 4 includes a depending annular wall 20 shaped to conform to the shape of the space 26 between the walls 28 and 29 of the drum 2. The rim 4 includes a short depending flange 22 which is spaced from the depending wall 20 thus defining an annular space 21 conforming generally to the shape and dimensions of the upper end of wall 29 of the drum 2. The wall 20 has an upwardly facing sloped lip 23 facing toward the space 21.

As shown in FIG. 5 the tamburello is about to be assembled with the membrane 3 positioned over the drum 2 and the rim 4 being positioned over the membrane 3. The membrane 3 is, preferably, cut in a circle larger in diameter than the diameter of the drum 2 for purposes that will presently be obvious. The rim 4 is then brought downwardly into contact with the membrane 3 forcing the same to wrap itself about the lower wall 20 of the rim and position itself between the walls 28 and 29 of the drum 2. Further downward pressure applied through the rim 4 forces the membrane then to shape itself within the annular groove 21 and about the upper end of the annular wall 29. It will be apparent that during assembly the walls 28 and 29 spring apart slightly and that the assembly of the membrane 3 and rim 4 to the drum 2 comprises a snap action or snap fitting assembly. Ultimately, when fully assembly the lip 23 engages beneath the lip 27 with a portion of the membrane 3 therebetween. This arrangement is clearly shown in FIG. 6. The membrane 3 extends over the top end of the wall 29 and then downwardly along the wall 29 between the wall 29 and the short flange 22 on the rim to about the bottom edge of the flange 22 or slightly therebelow or thereabove. It will be appreciated that the membrane 3 is cut sufficiently large to permit its conforming to the space 26, wall 20, upper end of wall 29 and space 21 as shown. Once assembled, it is essentially impossible to disassemble the membrane 3 and rim 4 from the drum 2 because of the locking interrelationship between the lips 27 and 23. The resiliency in the walls 28 and 29, while sufficient for assembly, is so small as to make removal of the rim practically impossible. Indeed, it will be noted that the space 26 and the wall 20 have a generally cooperating wedge shape which permits entry of the wall 20 into the space 26 while the engagement of lip 23 and lip 27 prevents removal of the rim 4 from the drum 2.

It is also preferred to apply a suitable adhesive at the inner face between the membrane 3 and one or both of (preferably both) the drum walls 28 and 29 and the rim wall 20.

The assembly of the tamburello in the manner just described insures that the membrane 3 is tautly stretched and further that it is stretched equally in all directions. It has also been found that by extending the inner annular wall 28 outwardly beyond the groove 26 and beyond the upper end of the wall 29, the depending wall 20 of the rim and the upper edge of the wall 28 may cooperate in very uniformly and tautly stretching the membrane during assembly. The material of the membrane 3 may be any suitable material with a synthetic, non-woven fabric made of polyvinylchloride fibers compressed under heat and set into shape being presently preferred. Such a product is presently commercially available.

While the tamburello shown in the drawings has a cylindrical drum 2 other shapes are contemplated. Cylindrical tamburellos are conventionally used by all players except when serving. A special server's tamburello is often used at least professionally in which the shape of the drum is ovoid. The present invention is equally useful in tamburellos of such different shape.

I claim:

1. A tamburello for batting game balls comprising a rigid drum having two opposite edges defining two opposite open ends in said drum, a membrane capable of being stretched and tautly secured across one of said open ends, a rim for securing said membrane to said open end of said drum, an outwardly opening annular groove in said drum terminating in the upper portion of the edge defining said one end thereof, a downwardly depending annular wall on said rim, said depending wall being positioned within said annular groove with a peripheral portion of said membrane therebetween, and wherein said annular groove in said drum and said annular wall of said rim each have members capable of tight snap-fitting interlocking engagement with each other upon assembly of said drum and said rim together such that said membrane is tautly secured between portions of said drum and said rim, said taut securement of said membrane resulting solely from said snap-fitting interlocking engagement of said members.

2. The tamburello of claim 1 in which said groove is in part defined by a first annular wall having an inwardly extending lip, the depending wall of said rim having a lip positioned in confronting relationship to said first mentioned lip and lockingly engaged therewith with a portion of the membrane therebetween.

3. The tamburello of claim 2 in which the cross-sectional shape of said depending rim wall and said groove is a wedge shape.

4. The tamburellos of either claim 2 or claim 3 in which said groove is in part defined by a second annular wall spaced inwardly of said first annular wall, and said inner annular wall extending outwardly beyond said groove and beyond said first annular wall.

5. A tamburello for batting game balls comprising a drum having two opposite edges defining opposite open ends in said drum, a membrane capable of being tautly secured across one open end of said drum, an outwardly opening annular groove in said drum terminating in the upper portion of the edge defining said one open end, a rim being dimensioned and configured so as to cooperate with said groove in tautly securing said membrane to said drum, said drum and said rim each having members capable of tight snap-fitting interlocking engagement with each other upon assembly of said drum and said rim together, said membrane being tautly secured across said one open end and between portions of said groove and said rim, said tight snap-fitting interlocking engagement of said members providing the sole engagement capability in the taut securement of said membrane, a strap secured to said drum adjacent said rim, and a hand grip positioned at the opposite open end of said drum on the edge of said drum and in alignment with said strap.

6. The tamburello of claim 5 in which said hand grip is generally U shaped in cross-section forming a channel engaged over the edge of said opposite opening.

7. The tamburello of either claim 5 or claim 6 in which said strap has at least one opening adjacent each end thereof, a securing lug at each end of the strap each having a stem extending through an opening in the strap and secured to said drum, and each of said securing lugs having an enlarged head of greater dimension than the opening in said strap and positioned on the opposite side of said strap from said drum.

8. A tamburello comprising a drum having two opposite edges defining opposite open ends in said drum, a membrane tautly secured across one open end of said drum, a rim securing said membrane to said drum, a strap secured to said drum adjacent said rim, and a hand grip positioned at the opposite open end of said drum on the edge of said drum and in alignment with said strap, said hand grip being generally U shaped in cross-section forming a channel engaged over the edge of said opposite opening, said strap having at least one opening adjacent each end thereof, a securing lug at each end of the strap each having a stem extending through an opening in the strap and secured to said drum, and each of said securing lugs having an enlarged head of greater dimension than the opening in said strap and positioned on the opposite side of said strap from said drum, said strap being sufficiently elastic so as to permit stretching of the openings to pass the same over the heads of their respective lugs onto the stem portions thereof, and said lugs being formed integrally with said drum.

9. A tamburello comprising a drum having two opposite edges defining opposite open ends in said drum, a membrane tautly secured across one open end of said drum, a rim securing said membrane to said drum, a strap secured to said drum adjacent said rim, and a hand grip positioned at the opposite open end of said drum on the edge of said drum and in alignment with said strap, said strap having at least one opening adjacent each end thereof, a securing lug at each end of the strap each having a stem extending through an opening in the strap and secured to said drum, and each of said securing lugs having an enlarged head of greater dimension than the opening in said strap and positioned on the opposite side of said strap from said drum, said strap being sufficiently elastic so as to permit stretching of the openings to pass the same over the heads of their respective lugs onto the stem portions thereof, and said lugs being formed integrally with said drum.

10. The tamburello of claim 8 or 9 in which said drum has reinforcement ridges on the outer surface thereof, said hand grip having grooves therein complimentary in shape to and engaging said ridges, and said hand grip frictionally engaging said drum.

11. A tamburello comprising a rigid drum having two opposite edges defining two opposite open ends in said drum, a membrane stretched across one of said open ends, a rim for securing said membrane to said one open end, an outwardly opening annular groove in said drum in the edge defining said one end thereof, a downwardly depending annular wall on said rim, said depending wall being positioned within said annular groove with a peripheral portion of said membrane therebetween, said groove being defined in part by a first annular wall having an inwardly extending lip, said depending wall of said rim having a lip positioned in confronting relationship to said first mentioned lip and lockingly engaged therewith with a portion of the membrane therebetween, said groove also being in part defined by a second annular wall spaced inwardly of said first annular wall, said inner annular wall extending outwardly beyond said groove and beyond said first annular wall, the cross-sectional shape of said depending rim wall and said groove being a wedge shape, a strap secured to said drum adjacent said rim, a generally U shaped hand grip engaged over the edge of said drum opposite to said rim, said strap having at least one opening adjacent each end thereof, a securing lug for each end of said strap having a stem extending through an opening in said strap and secured to said drum, an enlarged head on each of said securing lugs of greater dimension than the opening in said strap and positioned on the opposite side of said strap from said drum, said strap being sufficiently elastic to permit streching of the openings to pass the same over the heads of their respective lugs and onto the stem portion thereof, said lugs being formed integrally with said drum, reinforcing ridges on the outer surface of said drum, said hand grip having grooves therein complimentary to and engaging said ridges, and said hand grip frictionally engaging said drum.

12. A tamburello for use in a game of palla tamburello, comprising a drum having at least one open end, said drum having an outwardly extending annular groove in said open end of said drum, said groove having a continuous radially inwardly extending flange positioned about the outermost wall of said groove, a membrane capable of being stretched and tautly secured across said open end, a rim configured and dimensioned so as to be capable of seating within said groove, said rim having a downwardly depending annular wall including a radially outwardly extending flange projecting from the outermost surface of said annular wall, said rim flange dimensioned and configured so as to be able to snappingly engage said groove flange in a tight fitting interlocking engagement such that said membrane is stretched and tautly secured therebetween, a strap secured to said drum adjacent said rim, said strap having at least one opening adjacent each end thereof, a securing lug at each end of the strap each having a stem extending through an opening in the strap and secured to said drum, and each of said securing lugs having an enlarged head of greater dimension than the opening in said strap and positioned on the opposite side of said strap from said drum, said strap being sufficiently elastic so as to permit stretching of the openings to pass the same over the heads of their respective lugs onto the stem portions thereof, and said lugs being formed integrally with said drum.

* * * * *